US006347755B1

(12) United States Patent
Hostettler

(10) Patent No.: US 6,347,755 B1
(45) Date of Patent: Feb. 19, 2002

(54) ROLLER MILL

(75) Inventor: Rene Hostettler, Sirnach (CH)

(73) Assignee: Buhler AG (CH)

( * ) Notice: Subject to any disclaimer, the term of this patent is extended or adjusted under 35 U.S.C. 154(b) by 0 days.

(21) Appl. No.: 09/555,645

(22) PCT Filed: Aug. 19, 1998

(86) PCT No.: PCT/CH98/00352

§ 371 Date: Jul. 20, 2000

§ 102(e) Date: Jul. 20, 2000

(87) PCT Pub. No.: WO99/29430

PCT Pub. Date: Jun. 17, 1999

(30) Foreign Application Priority Data

Dec. 5, 1997 (DE) ..... 197 53 958

(51) Int. Cl.[7] ..... B02C 4/42
(52) U.S. Cl. ..... 241/101.2; 241/143
(58) Field of Search ..... 241/143, 101.2, 241/235, 234, 230; 474/153

(56) References Cited

U.S. PATENT DOCUMENTS 2,086,659 A * 7/1937 Armstrong ..... 241/230
3,338,107 A 8/1967 Kickhaefer
5,527,500 A 6/1996 Specht
5,566,902 A * 10/1996 Thom ..... 241/234

FOREIGN PATENT DOCUMENTS

| | | |
|---|---|---|
| DE | 1 107 033 | 5/1961 |
| DE | 27 30 166 | 1/1978 |
| DE | 33 04 832 | 9/1983 |
| EP | 0 334 919 | 9/1993 |
| EP | 0 425 626 | 10/1993 |
| GB | 1460628 | * 1/1977 |
| GB | 1 460 628 | 1/1977 |
| GB | 2115722 | * 9/1983 |
| GB | 2 115 722 | 9/1983 |
| IT | 1198054 | 10/1986 |
| WO | 90/14165 | 11/1990 |
| WO | WO 90/14165 | * 11/1990 |

* cited by examiner

*Primary Examiner*—Mark Rosenbaum
(74) *Attorney, Agent, or Firm*—Finnegan, Henderson, Farabow, Garrett & Dunner L.L.P.

(57) ABSTRACT

A cylinder mill for grinding grains and other granular products includes an overdrive mechanism for effecting varying rotation speeds. The overdrive mechanism includes a belt tightener and tightening pulley. The tightening pulley has two sections that are separately adjustable to achieve different tightnesses. This permits an essentially constant tension in the belts comprising the overdrive mechanism such that the belts can operate smoothly.

6 Claims, 3 Drawing Sheets

ROLLER MILL

Figure 1:
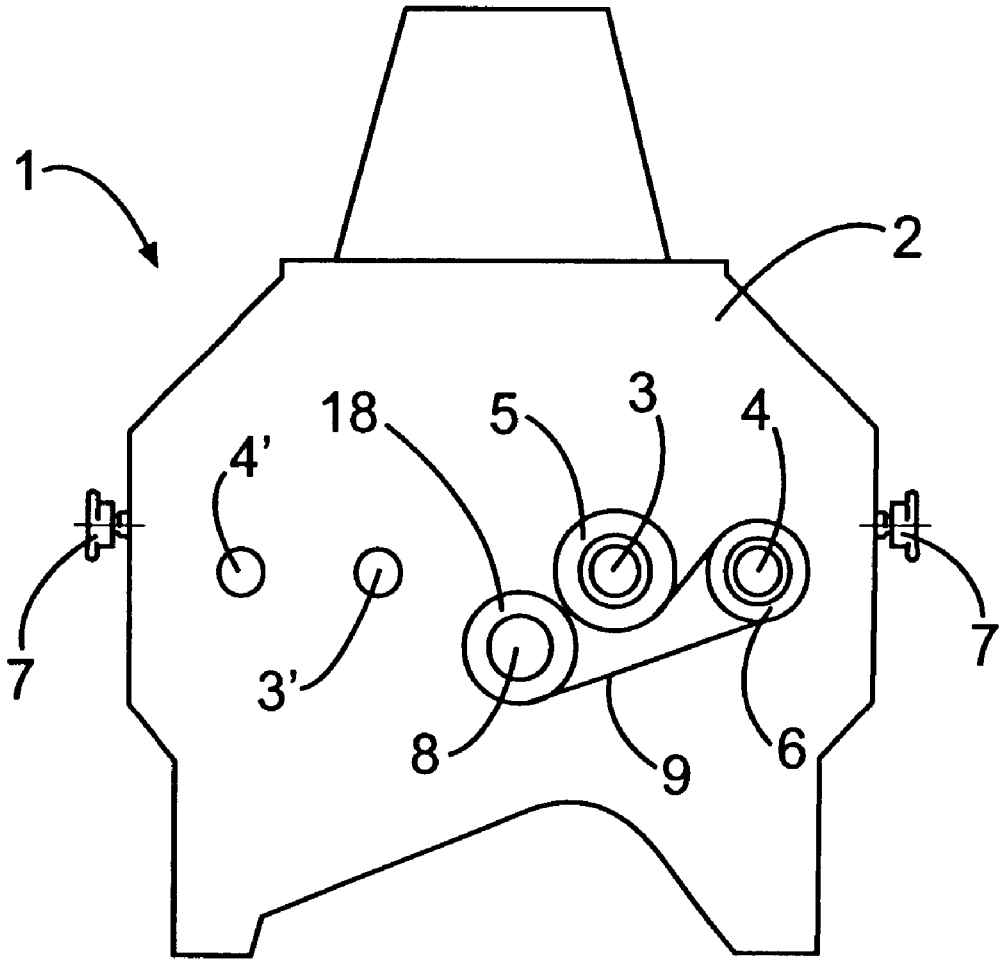

The invention concerns a cylinder mill to grind a granular product, such as grain, etc. into flour, cracked grain, semolina, etc. It especially concerns the overdrive of such cylinder mills with at least one pair of rollers with corrugated or smooth rollers.

Cylinder mills to grind grain contain at least two or four pairs of rollers as described in DE-C-2730166 or as described in EP-B-334919. The rollers of a roller pair rotate in the opposite direction and with at different speeds to crush and mill the grains. The roller gap can usually be varied.

Normally the faster-running roller is driven and connected to the slower-running roller with an overdrive. Such an overdrive is primarily constructed in the form of gearing that, however, must be lubricated, is very loud, and requires exchange gears to adapt to milling conditions which can differ widely. For quite a while, there has been an attempt to overcome the disadvantages of gears by using smooth or contoured belts. In addition to solutions using a V-belt, belts with teeth on both sides (e.g. U.S. Pat. No. 3,338,107) or multiple V toothed belts (e.g. TIMING-VEE) were developed. For example, DEAS 1107033 describes a combination V-belt and toothed belt with a toothed side and a V-shaped side of the belt that runs between three toothed belt pulleys, and that also drives an outer V-belt pulley.

A similar solution for a cylinder mill is described in DE-A-3304832. The double-sided toothed belt runs around belt pulleys of the rollers, and also runs around a toothed belt pulley of the drive and an idler pulley.

GB-A-1460628 discloses a belt drive for variable speeds with an adjustable guide pulley for 2 belts on a movable slide in a swinging arm. Any imprecision of the arm alignment can be corrected by cam disks on the rotary axes.

There is another prior-art toothed-belt overdrive that uses toothed V-belts found in ITPS 1198054 and EP-B-425626, and WO-A-90/14161. The latter describes a cylinder mill with at least one roller pair. The shaft of the slower-running roller carries a pulley that has teeth with notches parallel to the axis and includes a driving device, which is kept under tension by a third driving pulley with an adjustable position. The whole pulley is adjustable using regulating screws or an eccentric. The faster running roller is also equipped with a pulley that has teeth with notches. But these are arranged at right angles to the shaft axis. The driving device itself is a belt treaded on the outside and inside, which engages snugly in the profiles of the above mentioned three pulleys, meaning with a tooth or spline profile.

The width of the pulleys is designed, so that normally three belts can be put on parallel in order to increase the power to be transmitted. According to the state of the art mentioned above these are tightened simultaneously and wear out differently. It is very labour-consuming and not entirely possible to tighten the belts evenly. The problems can not be solved even by previous assessment and measuring.

The invention is therefore based on the task of avoiding the illustrated disadvantages of the state of the art, and therefore achieving an even tension of the individual belts and consequently an even wear.

The applicant's studies showed that the inner belt or inner belt parts, respectively, tend to wear out first due to the strain of the grinding rolls, which can not be avoided in the operating state. As a result any assessment or measuring of belts will be at least partially ineffective. It is rather important to observe these different conditions of wear. According to the invention a parted pulley (idler pulley) is therefore designed in order to tighten the belts individually. Preferably this pulley is partially divided into two sections.

More in-depth studies by the applicant showed that the assumed maximum transmission performance could not be achieved in practice. Therefore it normally seems unnecessary to use three or more belts. This also makes adjustment easier.

In the following, an example of realization of the invention will be further described. Shown in the drawings are:

FIG. 1 Schematic representation of a roller overdrive

Figure 2:
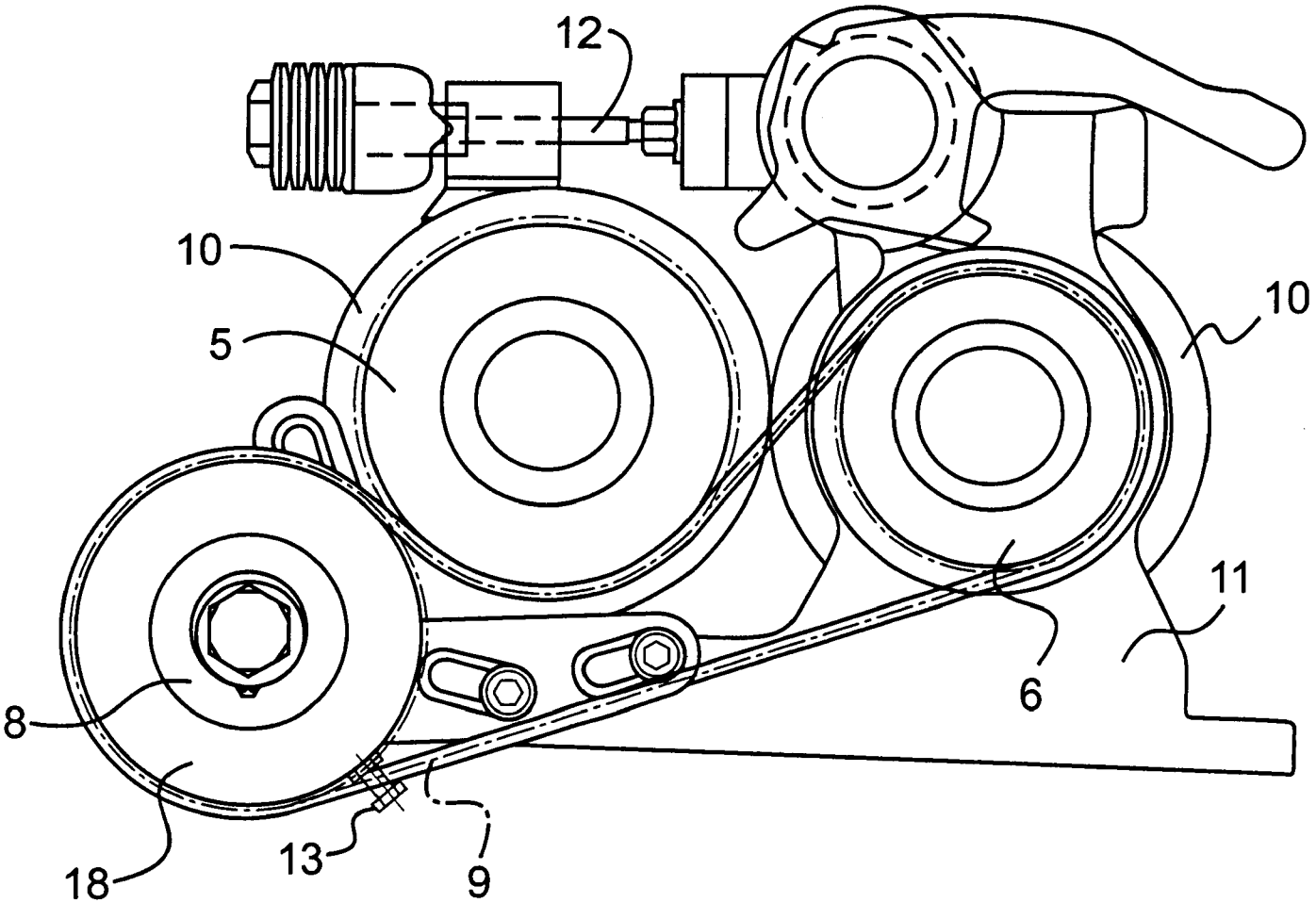

FIG. 2 Overdrive of the roller set

Figure 3:
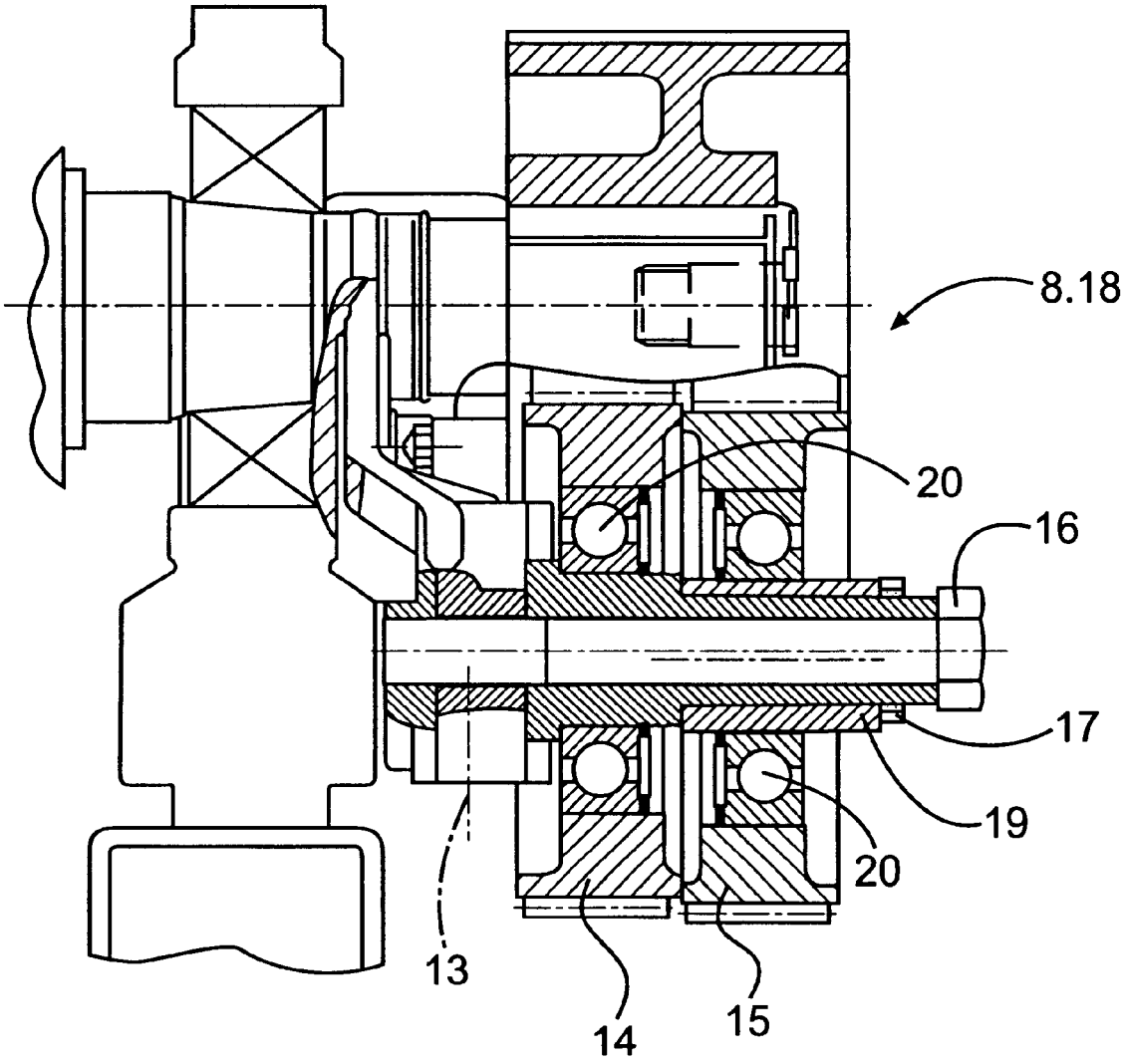

FIG.3 Representation of the belt tightener (partial section)

In addition to the feed and discharge devices for the grain that are not explicitly shown, the 4-roller cylinder mill 1 with a housing 2 (as described in DE-C-2730166) contains two pairs of horizontally mounted rollers 3, 3', 4, 4', whose ends are provided with a pulley 5 and a second pulley 6. The roller gap of the roller pair 3, 4, and 3', 4' can be adjusted using a motor or manual adjustment mechanism or device 7. Also provided is an idler or belt tightener 8 with a tightening pulley 18. An overdrive mechanism such as two conventional belts 9 contoured on both sides run around the pulleys 5,6 and the tightener pulley 18. The inside of belt 9 preferably has numerous Vs in the lengthwise direction, and the outside has a toothed profile perpendicular to the lengthwise direction.

In addition, the tightener pulley 18 of the belt tightener 8 has separately adjustable sections 14, 15. The inner section 14 can be adjusted with a screw 13, and the outer section 15 can be adjusted by means of a cam disk 19. The cam disk 19 can be fixed with a nut 17. A screw 16 holds a shaft. The tension can be optimized for each belt 9 to achieve an even overdrive, or transmission of torque, or even wear. Sections 14, 15 are preferably held by roller bearings 20.

The two belts 9 can be used to adapt to any operating conditions.

The rollers of a pair 3, 4 and 3', 4' are in a roller set as described in DE-C-2730166. The rollers are mounted in bearing houses 10, 10'. In the bearing housing 10 is connected to a frame mount 11. This roller set is mounted on a base of the housing 2 (not shown in detail). The milling gap setting device 12 is also designed as foreign-body protection device or and overload-protection device.

With such a cylinder mill 1 that is primarily used in milling, the rollers of a pair rotate and different speeds with a specific roller gap. Not only pressure but also friction and shearing force can be exerted on the grain. A main drive (not shown) on one side of the cylinder mill 1 directly drives one of the two rollers of the pair, in general, the faster roller 4, 4'. The slower roller 3, 3 is entrained by means of the product by the faster roller 4, 4 during milling. To achieve different speeds, an overdrive (belt 9) is used with different pulley diameters. Since the rollers of the pair rotate counterclockwise, the first pulley 5 must lie outside of the belt 9. A belt tightener 8 must also be used given the adjustable roller gap (and hence the axial distance between the rollers). A pulley 5 is hence provided with a toothed profile parallel to the axis of the roller 3 (3'). The second pulley 6 and the tightening pulley 18 contrastingly have a flat surface or a V-groove surface that runs in a peripheral direction, or a toothed profile at a right angle to the axis of the roller 4 (4'). The pulley and belt faces are adapted to each other. The first pulley 5 and belt 9 have a positive fit, and belt 9 and pulley 6 and tightening pulley 18 have a friction contact.

As shown with reference to FIGS. 1 and 2, the overdrive mechanism comprising belt(s) 9 is configured to engage the tightening pulley 18 and also to engage with the pulley 6 associated with the faster roller 4, 4' for more than approximately 180 degrees, and to engage with the pulley 5 associated with slower roller 3, 3' for less than approximately 180 degrees. This relative amount of engagement is evident by the amount of contact, as measured angularly, between the belt 9 and the respective pulleys 5, 6. The belt 9 also rotates the pulley 5 in an opposite direction to the pulley 6.

This arrangement is analogous to the other roller pair and can also be transferred to an 8-roller mill as in EP-B-334919. The invention is not limited to the portrayed embodiment.

ABBREVIATIONS

1 Cylinder mill
2 Housing
3 Roller
3' Roller
4 Roller
4' Roller
5 Pulley
6 Pulley
7 Manual adjusting device
8 Belt tightener
9 Belt
10 Bearing housing
10' Bearing housing
11 Frame mount
12 Grain gap adjustment
13 Screw
14 Section
15 section
16 Screw
17 Nut
18 Tightening pulley
19 Cam disk
20 Roller bearing

What is claimed is:

1. A cylinder mill to mill a granular product, comprising:

roller pairs mounted in a housing, said roller pairs being connected to a feed device and a discharge device for the granular product, each of said roller pairs including a faster-rotatable roller that is driven directly and a slower-rotatable roller; and an overdrive mechanism for driving said slower-rotatable roller, said overdrive mechanism including at least one belt and a belt tightener with a tightening pulley, wherein said overdrive mechanism is configured to rotate the tightening pulley, and to rotate a first pulley and a second pulley in opposite directions, the overdrive mechanism being further configured to engage the second pulley by more than approximately 180 degrees, and to engage the first pulley by less than approximately 180 degrees, and wherein the tightening pulley has two sections, the tightness of each said section being separately adjustable.

2. The cylinder mill of claim 1, wherein the cylinder mill is one of a 4-roller and 8-roller cylinder mill.

3. The cylinder mill of claim 1, wherein at least one of the sections of the tightening pulley can be adjusted with a cam disk.

4. The cylinder mill of claim 1, further comprising a device for adjusting the roller gap of the roller pairs.

5. The cylinder mill of claim 1, wherein the overdrive mechanism comprises at least two belts.

6. A cylinder mill to mill a granular product, comprising:

roller pairs mounted in a housing, said roller pairs being connected to a feed device and a discharge device for the granular product, each of said roller pairs including a faster-rotatable roller that is driven directly and a slower-rotatable roller; and an overdrive mechanism for driving said slower-rotatable roller, said overdrive mechanism including at least two belts and a belt tightener with a tightening pulley, wherein the tightening pulley has two sections, each section being associated with one of the at least two belts, the tightness of each said section being separately adjustable.

* * * * *